US010748706B2

(12) United States Patent
Yu et al.

(10) Patent No.: US 10,748,706 B2
(45) Date of Patent: Aug. 18, 2020

(54) METHOD FOR PRODUCING SINTERED R-IRON-BORON MAGNET

(71) Applicant: Yantai Zhenghai Magnetic Material Co., Ltd., Yantai (CN)

(72) Inventors: Yongjiang Yu, Yantai (CN); Xiuyan Sun, Yantai (CN); Nan Zhao, Yantai (CN); Xiaodong Tian, Yantai (CN)

(73) Assignee: YANTAI ZHENGHAI MAGNETIC MATERIAL CO., LTD., Yantai (CN)

( * ) Notice: Subject to any disclaimer, the term of this patent is extended or adjusted under 35 U.S.C. 154(b) by 242 days.

(21) Appl. No.: 15/690,268

(22) Filed: Aug. 29, 2017

(65) Prior Publication Data

US 2018/0061568 A1 Mar. 1, 2018

(30) Foreign Application Priority Data

Aug. 31, 2016 (CN) ..... 2016 1 0781202

(51) Int. Cl.

| | |
|---|---|
| ***H01F 41/02*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 1/057*** | (2006.01) |
| ***C22C 38/02*** | (2006.01) |
| ***C22C 38/18*** | (2006.01) |
| ***C22C 38/12*** | (2006.01) |
| ***C22C 38/08*** | (2006.01) |
| ***C22C 38/04*** | (2006.01) |
| ***H01F 1/08*** | (2006.01) |
| *B22F 3/24* | (2006.01) |
| *B22F 1/00* | (2006.01) |
| *B22F 9/04* | (2006.01) |

(52) U.S. Cl.

CPC ..... *H01F 41/0266* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/18* (2013.01); *H01F 1/0577* (2013.01); *H01F 1/086* (2013.01); *H01F 41/0246* (2013.01); *H01F 41/0293* (2013.01); *B22F 1/0011* (2013.01); *B22F 9/04* (2013.01); *B22F 2003/242* (2013.01); *B22F 2009/044* (2013.01); *B22F 2998/10* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 5,013,411 A * | 5/1991 | Minowa | ..... | H01F 1/0577 148/102 |
| 2014/0352847 A1* | 12/2014 | Yu | ..... | B22F 3/26 148/104 |
| 2016/0104571 A1* | 4/2016 | Komura | ..... | B22F 3/03 419/30 |

FOREIGN PATENT DOCUMENTS

| | | | | |
|---|---|---|---|---|
| EP | 2555207 A1 * | 2/2013 | ..... | C22C 38/005 |
| JP | 2009146890 A * | 7/2009 | | |

* cited by examiner

*Primary Examiner* — Alexandra M Moore
*Assistant Examiner* — Adil A. Siddiqui
(74) *Attorney, Agent, or Firm* — Matthias Scholl P.C.; Matthias Scholl

(57) ABSTRACT

A method for producing a sintered R-iron (Fe)-boron (B) magnet, the method including: (1) producing a sintered magnet R1-Fe—B-M, where R1 is neodymium (Nd), praseodymium (Pr), terbium (Tb), dysprosium (Dy), gadolinium (Gd), holmium (Ho), or a combination thereof; M is titanium (Ti), vanadium (V), chromium (Cr), manganese (Mn), cobalt (Co), nickel (Ni), gallium (Ga), calcium (Ca), copper (Cu), Zinc (Zn), silicon (Si), aluminum (Al), magnesium (Mg), zirconium (Zr), niobium (Nb), hafnium (Hf), tantalum (Ta), tungsten (W), molybdenum (Mo), or a combination thereof; (2) removing oil, washing using an acid solution, activating, and washing using deionized water the sintered magnet, successively; (3) mixing a superfine terbium powder, an organic solvent, and an antioxidant to yield a homogeneous slurry, coating the homogeneous slurry on the surface of the sintered magnet; and (4) sintering and aging the sintered magnet.

6 Claims, No Drawings

METHOD FOR PRODUCING SINTERED R-IRON-BORON MAGNET

CROSS-REFERENCE TO RELATED APPLICATIONS

Pursuant to 35 U.S.C. § 119 and the Paris Convention Treaty, this application claims foreign priority to Chinese Patent Application No. 201610781202.3 filed Aug. 31, 2016, the contents of which are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to a method for producing a sintered R-Iron-Boron (R—Fe—B) magnet.

Description of the Related Art

Conventional methods for producing sintered R-Iron-Boron (R—Fe—B) magnets have the following defects: the surface of the sintered magnets is coated with a high content oxygen and fluoride layer, and to guarantee the properties of the magnets, the high content oxygen and fluoride layer requires to be removed through machining and grinding. This increases production costs and leads to the waste of materials.

SUMMARY OF THE INVENTION

In view of the above-described problems, it is one objective of the invention to provide a method for producing a sintered R-Iron-Boron (R—Fe—B) magnet. The method involves no machining and grinding treatment, so it is efficient, and the materials are saved. The resulting magnet has a good appearance and improved coercive force.

To achieve the above objective, in accordance with one embodiment of the invention, there is provided a method for producing a sintered R-Iron-Boron (R—Fe—B) magnet, the method comprising:

(1) producing a sintered magnet R1-Fe—B-M, wherein R1 is neodymium (Nd), praseodymium (Pr), terbium (Tb), dysprosium (Dy), gadolinium (Gd), holmium (Ho), or a combination thereof, and accounts for 26-33 wt. % of the total weight of the sintered magnet R1-Fe—B-M; M is titanium (Ti), vanadium (V), chromium (Cr), manganese (Mn), cobalt (Co), nickel (Ni), gallium (Ga), calcium (Ca), copper (Cu), Zinc (Zn), silicon (Si), aluminum (Al), magnesium (Mg), zirconium (Zr), niobium (Nb), hafnium (Hf), tantalum (Ta), tungsten (W), molybdenum (Mo), or a combination thereof, and accounts for 0-5 wt. % of the total weight of the sintered magnet R1-Fe—B-M; the boron (B) accounts for 0.5-2 wt. % of the total weight of the sintered magnet R1-Fe—B-M; and the rest is Fe;

(2) removing oil, washing using an acid solution, activating, and washing using deionized water the sintered magnet, successively;

(3) mixing a superfine terbium powder, an organic solvent, and an antioxidant to yield a homogeneous slurry, coating the homogeneous slurry on a surface of the sintered magnet; and (4) sintering and aging the sintered magnet until the following parameters are satisfied:

Hcj (4)−Hcj (1)>10 kOe; Br (1)−Br (4)<0.2 kGs;

where, the Hcj (4) represents a coercive force of the sintered magnet obtained in (4); Hcj (1) represents the coercive force of the sintered magnet obtained in (1); kOe is a unit of coercive force; Br (4) represents a residual magnetism of the sintered magnet obtained in (4); Br (1) represents the residual magnetism of the sintered magnet obtained in (1); and kGs is a unit of residual magnetism.

In a class of this embodiment, the superfine terbium powder is prepared as follows: processing a pure terbium ingot into ingot pieces having a minimum length of 1-10 mm in a direction or crushing the pure terbium ingot into granules having a minimum diameter of less than 2-10 mm in a direction, and milling the ingot pieces or granules using a jet mill to yield terbium powders having an average particle size of between 0.5 and 3 μm; an oxygen content of the prepared terbium powders is less than 1500 ppm, and a carbon content of the prepared terbium powders is less than 900 ppm.

In a class of this embodiment, in (3), the superfine terbium powder accounts for 50-80 wt. % of the total weight of the slurry, the antioxidant accounts for 1-10 wt. % of the total weight of the slurry, and the antioxidant is 1,3,5-benzotrichloride, butylated hydroxytoluene, 4-hexylresorcinol, or a mixture thereof.

In a class of this embodiment, in (3), a thickness of the sintered magnet in at least one direction is less than 15 mm, and a thickness of a superfine terbium powder layer on the surface of the sintered magnet is between 10 and 100 μm.

In a class of this embodiment, in (4), a sintering temperature is between 850 and 970° C., a sintering time is between 5 and 72 hrs, and a sintering pressure is between $10^{-3}$ and $10^{-4}$ Pa; an aging temperature is between 470 and 550° C., and an aging time is between 2 and 5 hrs.

In a class of this embodiment, the terbium powders have an average particle size of between 1 and 2.5 μm; the oxygen content of the prepared terbium powders is less than 1000 ppm, and the carbon content of the prepared terbium powders is less than 700 ppm.

Compared to the prior art, the method for producing a sintered R-Iron-Boron (R—Fe—B) magnet in accordance with embodiments of the invention has the following advantages: since fluorides and oxyfluorides are not involved, the fluorine and oxygen content of the magnet after diffusion does not increase; the excessively high fluorine and oxygen content reduces the magnetic performance of the magnet; the magnet after diffusion has a clean appearance; the high-level oxygen and high-level fluoride layers on the surface of the magnet need not to be ground off by machining, saving the machining cost, and simplifying the production process. The terbium powder layer with the average particle size of 1-2.5 μm is arranged on the surface of the sintered R—Fe—B magnet for diffusion. Compared to magnets after treatment by oxides, fluorides and oxyfluorides, the magnet has a good appearance and also needs no machining. Compared to vapor diffusion, the method increases the coercive force of the magnet by more than 10 kOe and reduces the residual magnetism thereof by less than 0.2 kGs, so the magnetic performance of the magnet produced by the method is far superior to the magnetic performance of the magnets obtained by vapor diffusion treatment. The magnets obtained using the method has excellent magnetic performance, and the production method reduces the usage amount of magnetic steel and heavy rare earth, so it is efficient.

DETAILED DESCRIPTION OF THE EMBODIMENTS

For further illustrating the invention, experiments detailing a method for producing a sintered R—Fe—B magnet are described hereinbelow combined with the drawings. It should be noted that the following examples are intended to describe and not to limit the invention.

The sintered magnet of one embodiment of the present disclosure is produced by the following method:

First, the semi-finished alloy was sintered by melting metal or alloy materials in a vacuum or inert gases, typically in the argon gas; pouring starts at a temperature of 1300-1600° C.; the preferred temperature for pouring was 1400-1500° C.; the melted material was poured onto quenching rollers to form scales; the rotation speed of the quenching rollers was 20-60 rpm; the preferred rotation speed was 30-50 rpm; and cooling water run through the interior of the quenching rollers. Second, the scales were produced into powders with the particle size of 1-10 μm; and the preferred particle size was 2-5 μm. Third, the 15 kOe magnetic field orientation was adopted for compression molding. Fourth, green pressings were sintered in argon gas in a sintering furnace at a temperature of 900-1300° C. for 1-100 hrs; and preferably, the green pressings were sintered at a temperature of 1000-1100° C. for 2-50 hrs. Fifth, ageing treatment was carried out at a temperature of 450-650° C. for 2-50 hrs (the aging treatment refers to the heat treatment process that the properties, shapes and sizes of the alloy work pieces after solution treatment, cold plastic deformation or casting and forging change with time at a higher temperature or room temperature.); and preferably, the ageing treatment was carried out at a temperature of 450-500° C. for 4-20 hrs to produce semi-finished sintered magnets. Sixth, the semi-finished sintered magnets were processed into sintered magnets whose thickness was 100 mm along the longest side and the maximum thickness was 15 mm along each anisotropic direction.

Then, the sintered magnet went through ultrasonic oil removal for 30 seconds, was dipped in dilute nitric acid for 15 seconds two times, was activated by dilute sulphuric acid for 15 seconds and washed by deionized water in succession. Then, the sintered magnet can be used as a sintered magnet being treated.

The terbium powder used by the embodiment can be produced by the following method:

Pure terbium ingots were machined into ingot bars whose thickness was less than 10 mm at the thinnest direction, the preferred thickness was 5 mm and the best thickness was 1 mm; or, pure terbium ingots were crushed into particles whose thickness was less than 10 mm at the thinnest direction, the preferred thickness was 5 mm and the best thickness was 2 mm. Then, after grinding treatment by airflows, the ingot bars or particles were made into terbium powder with the particle size of 0.5-3 μm, and the preferred particle size was 1-2.5 μm.

If the average particle size of the terbium powder was greater than 3 μm, when the surface of the sintered was covered with the magnet, the effective contact area between the terbium powder and the magnet surface was small. The small effective contact area was not good for the effective contact between the grain boundary phase of the magnet surface and the terbium powder during high-temperature treatment. Consequently, the diffusion effect was not obvious and the coercive force of the magnet was not improved significantly. If the average particle size of the terbium powder was less than 0.5 μm, the activity of the terbium power was improved because the particle size of the terbium powder was too low. Consequently, the terbium powder was very easy to oxidize, the operability was reduced significantly and the cost was improved greatly.

During the production of terbium powder, the oxygen content and carbon content of the terbium powder need to be controlled strictly. Therefore, the oxygen content of the terbium powder was less than 1500 ppm and the carbon content of the terbium powder was less than 900 ppm. However, the preferred oxygen content was less than 1000 ppm and the preferred carbon content was less than 700 ppm. When the oxygen content of the terbium powder was greater than 1500 ppm, particles with a smaller particle size in the terbium powder was oxidized, the oxidized terbium does not displace neodymium at the grain boundaries of the sintered magnet at a high temperature, and consequently the treatment effect was reduced. When the carbon content of the terbium powder was greater than 900 ppm, the contact between the terbium powder and the sintered magnet was hindered and then the treatment effect of the magnet was affected.

The slurry used by the invention can be produced by the following method:

Superfine terbium powder, an organic solvent and an antioxidant were mixed in proportion and stirred evenly to produce the slurry.

The preferred weight percent of the terbium powder in the slurry was 50-80%. When the weight percent of the terbium powder in the slurry was too high, the viscosity of the slurry becomes larger. The larger viscosity was not good for forming a uniform coating on the surface of the sintered magnet, and it was also difficult to control the thickness of the coating on the surface of the sintered magnet. Therefore, it was not good for improving the overall magnetic performance of the magnet evenly. When the weight percent of the terbium powder was lower, the distribution of the terbium powder on the surface of the magnet was not uniform and some parts of the surface even were not covered by terbium powder. Therefore, the improvement of the magnetic performance of the magnet was adversely affected.

The antioxidant was 1,3,5-benzotrichloride, butylated hydroxytoluene, 4-hexylresorcinol or a mixture thereof.

The weight percent of the antioxidant was 1-10%. When the antioxidant content of the slurry was too low, some superfine terbium powder was oxidized and consequently the improvement of magnet performance was lowered. When the antioxidant content of the slurry was too high, the organic matter in the surface coating of the magnet rose. Consequently, the vacuum degree in the heat treatment equipment was affected during heat treatment, and carbon was left on the surface of the magnet and entered the interior of the sintered magnet. All were not good for the improvement of the magnet performance.

The preferred organic solvent was alcohols, ketones and ethers which can dissolve with antioxidant, was easy to volatilize and has low viscosity. The organic solvent can be ethanol, acetone and butanone. If the organic solvent and the antioxidant do not dissolve completely, the coating was not uniform and the superfine terbium powder was oxidized. If the organic solvent has poor volatility, it was very difficult to form a uniform dry film after the organic solvent was applied on the surface of the sintered magnet. If the viscosity of the organic solvent was too high, the flowability of the organic solvent on the surface of the sintered magnet was limited and consequently, the coating was not uniform.

The methods for forming a uniform pure terbium powder coating on the surface of the sintered magnet include but were not limited to spraying, dip-coating and screen printing. For example, as for the spraying method, the magnet can be hung on a rack first; then, the slurry was sprayed on the surface of the magnet; and finally, a uniform terbium powder layer was formed on the surface of the magnet after drying.

The thickness of the terbium powder coating on the surface of the sintered magnet should be 10-100 μm. If the thickness of the coating was less than 10 μm, the diffusion effect was not obvious; the performance of the sintered magnet was improved obviously after heat treatment; the performance of the central part of the magnet can hardly change; and the performance uniformity between the surface of the magnet and the center of the magnet was poorer. If the thickness of the coating was greater than 100 μm, it was easy to form alloy in the interface of the sintered magnet surface and the terbium powder coating during heat treatment; and the alloy causes peeling on the magnet surface and damages the sintered magnet.

In the embodiment, after the terbium powder coating was coated on the magnet surface, the sintered magnet was put in a vacuum furnace. The temperature inside the vacuum furnace was set at 850-970° C. The time for heat treatment was 5-72 hrs. The pressure inside the vacuum furnace was controlled between $10^{-3}$ Pa and $10^{-4}$ Pa.

If the temperature inside the vacuum furnace was lower than 800° C., the diffusion speed of terbium atoms on the surface of the sintered magnet surface become slow. Since the terbium atoms cannot effectively enter the interior of the sintered magnet, the surface concentration of terbium atoms became too high, the concentration of terbium atoms in the magnet center was low and even no terbium atom entered the magnet center. If the temperature was higher than 1000° C., terbium atoms diffused into grains, and made the surface performance of the sintered magnet poor. Consequently, the residual magnetism and the maximum magnetic energy product were reduced substantially and it was easy for terbium atoms to melt and form alloy on the sintered magnet surface and damage the magnet and the magnet appearance.

If the time for heat treatment was less than 5 hrs, there was no sufficient time for terbium on the surface to diffuse into the center of the sintered magnet. Consequently, the magnetic performance of the sintered magnet surface was higher than the magnetic performance of the sintered magnet center, the uniformity of the magnet become poor and the overall magnetic performance of the sintered magnet was not improved greatly. If the time for heat treatment exceeded 72 hrs, when terbium on the surface of the sintered surface was used up (Terbium diffuses into the interior of the magnet or evaporate into the treatment chamber), rare earth elements such as Pr and Nd in the sintered magnet continues volatilization. Consequently, the magnetic performance of the sintered magnet became poor.

Finally, after the heat treatment was conducted according to the set time, the heat treatment stopped and the temperature inside the vacuum sintering furnace was lowered and was less than 200° C. Then heat treatment resumes, the temperature inside the vacuum sintered furnace rose to 470-550° C., and the heat treatment time was 2-5 hrs. After the heat treatment was conducted according to the set time, the argon gas entered the vacuum sintering furnace and the temperature inside the vacuum sintered furnace cooled to room temperature.

Examples 1-7

According to the weight ratios of 23.8% of Nd, 5% of Pr, 0.6% of Dy, 0.4% of Tb, 68.29% of Fe, 0.5% of Co, 0.13% of Cu, 0.1% of Ga, 0.1% of Al, 0.12% of Zr and 1% of B, the pouring of Nd, Pr, Dy, Tb, Fe, Co, Cu, Ga, Al, Zr and B was completed in inert gas in a vacuum sintering furnace, the pouring temperature was 1450° C., the rotation speed of quenching rollers was 60 rpm, and the scale thickness was about 0.3 mm. The scales were produced into powder particles with the average particle size of 3.5 μm after jet milling. The 15 kOe magnetic field orientation was adopted for compression molding to produce pressings. The pressings were put in the argon gas in the sintering furnace to produce green pressings by sintering the pressings at 1100° C. for 5 hrs. Then green pressings went through ageing treatment at 500° C. for 5 hrs to produce semi-finished sintered magnets. The semi-finished sintered magnets was machined into 50M magnets with a size of 40 mm*20 mm*4 mm. The 50M magnet was marked as $M_0$.

50 M sintered magnet (40 mm*20 mm*4 mm) was dried after oil removal, acid pickling, activation and cleaning by deionized water. The magnet was hung on a rack first. The terbium powder with the average particle sizes of 0.8 μm, 1.2 μm, 1.6 μm, 2 μm, 2.4 μm, 3 μm and 5 μm, ethanol and 1,3,5-benzotrichloride were used to produce slurries J1, J2, J3, J4, J5, J6 and J7 respectively, and the ratio of terbium powder to ethanol to 1,3,5-benzotrichloride was 12:7:1. The slurries J1, J2, J3, J4, J5, J6 and J7 were sprayed on the surface of magnets respectively and then hot-blast air was adopted to dry the magnets to form a terbium power coating which was 25±3 μm in thickness on the magnet surface. The magnets were marked as M1, M2, M3, M4, M5, M6 and M7. The magnets were put in a vacuum sintering furnace at 970° C. in a vacuum (The pressure ranged from $10^{-3}$ Pa to $10^{-4}$ Pa) for 24 hrs. Then, the magnets go through ageing treatment at 500° C. for 5 hrs, the argon gas enters the furnace and the temperature inside the furnace dropped to room temperature. Through measurement and analysis, the magnet properties were shown in Table 1.

TABLE 1

| | Br | Hcj | (BH) max | Hk/iHc |
|---|---|---|---|---|
| | Unit | | | |
| Items | kGs | kOe | MGOe | — |
| $M_0$ | 14.40 | 15.20 | 50.1 | 0.97 |
| $M_1$ | 14.33 | 18.46 | 49.67 | 0.92 |
| $M_2$ | 14.30 | 26.70 | 49.63 | 0.96 |
| $M_3$ | 14.31 | 26.53 | 49.67 | 0.96 |
| $M_4$ | 14.29 | 26.55 | 49.53 | 0.96 |
| $M_5$ | 14.31 | 25.37 | 49.64 | 0.96 |
| $M_6$ | 14.30 | 23.49 | 49.60 | 0.96 |
| $M_7$ | 14.30 | 21.78 | 49.69 | 0.96 |

According to comparisons, the Hcj of the magnet M1 increases by about 3 kOe and it means that terbium powder with the average particle size of 0.8 μm is oxidized when forming a coating; the Hcj of the magnets M2, M3, M4 and M5 increases by about 10 kOe and it means that terbium powder with the average particle size of 1-2.5 μm has a better effect in improving the Hcj of the magnets when forming a coating; the Hcj of the magnet M6 increases by about 8 kOe; and the Hcj of the magnet M7 increases by about 7 kOe.

Examples 8-11

50 M magnetic sheets were produced by the melting, powder process, compression molding, heat treatment and cutting methods which were the same as the methods in Example 1. The 50 M sintered magnet (40 mm*20 mm*4 mm) was dried after oil removal, acid pickling, activation and cleaning by deionized water. The magnet was hung on a rack first. The terbium powder with the average particle sizes of 1.2 μm, 1.6 μm, 2 μm and 2.4 μm and ethanol were used to produce slurries J8, J9, J10 and J11 respectively, and the ratio of terbium powder to ethanol was 2:1. The slurries J8, J9, J10 and J11 were sprayed on the surface of magnets respectively and then hot-blast air was adopted to dry the magnets to form a terbium power coating which was 25 μm in thickness on the magnet surface. The magnets were marked as M8, M9, M10 and M11. The magnets were put in a vacuum sintering furnace at 970° C. in a vacuum (The pressure ranges from $10^{-3}$ Pa to $10^{-4}$ Pa) for 24 hrs. Then, the magnets went through ageing treatment at 500° C. for 5 hrs, the argon gas entered the furnace and the temperature inside the furnace dropped to room temperature. Through measurement and analysis, the magnet properties were shown in Table 2.

TABLE 2

| | Br | Hcj | (BH)max Unit | Hk/iHc |
|---|---|---|---|---|
| Items | kGs | kOe | MGOe | — |
| $M_8$ | 14.37 | 15.22 | 50.03 | 0.97 |
| $M_9$ | 14.38 | 15.10 | 50.11 | 0.95 |
| $M_{10}$ | 14.35 | 15.01 | 49.45 | 0.95 |
| $M_{11}$ | 14.38 | 15.18 | 50.08 | 0.95 |

It is obvious that coatings formed by slurries without antioxidant cannot improve the Hcj of magnets after heat treatment. It means that terbium powder is oxidized when forming a coating.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for producing a sintered R1-Fe—B-M magnet, the method comprising:

(1) producing a sintered magnet R1-Fe—B-M, wherein R1 is neodymium (Nd), praseodymium (Pr), terbium (Tb), dysprosium (Dy), gadolinium (Gd), holmium (Ho), or a combination thereof, and accounts for 26-33 wt. % of the total weight of the sintered magnet R1-Fe—B-M; M is titanium (Ti), vanadium (V), chromium (Cr), manganese (Mn), cobalt (Co), nickel (Ni), gallium (Ga), calcium (Ca), copper (Cu), Zinc (Zn), silicon (Si), aluminum (Al), magnesium (Mg), zirconium (Zr), niobium (Nb), hafnium (Hf), tantalum (Ta), tungsten (W), molybdenum (Mo), or a combination thereof, and accounts for 0-5 wt. % of the total weight of the sintered magnet R1-Fe—B-M; the boron (B) accounts for 0.5-2 wt. % of the total weight of the sintered magnet R1-Fe—B-M; and the rest is Fe;

(2) removing oil, washing the sintered magnet R1-Fe—B-M using an acid solution and deionized water successively;

(3) mixing a terbium powder, an organic solvent, and an antioxidant to yield a homogeneous slurry, coating the homogeneous slurry on a surface of the sintered magnet R1-Fe—B-M, wherein the antioxidant is 1,3,5-benzotrichloride, 4-hexylresorcinol, or a mixture thereof; and (4) sintering and aging the sintered magnet obtained in (3) until the following parameters are satisfied:

$$Hcj(4)-Hcj(1)>10\ kOe; Br(1)-Br(4)<0.2\ kGs;$$

wherein the Hcj (4) represents a coercive force of the sintered magnet obtained in (4); Hcj (1) represents the coercive force of the sintered magnet obtained in (1); kOe is a unit of coercive force; Br (4) represents a residual magnetism of the sintered magnet obtained in (4); Br (1) represents the residual magnetism of the sintered magnet obtained in (1); and kGs is a unit of residual magnetism.

2. The method of claim 1, wherein the terbium powder in (3) is prepared as follows: processing a pure terbium ingot into ingot pieces having a minimum length of 1-10 mm in a direction or crushing the pure terbium ingot into granules having a minimum diameter of less than 10 mm in a direction, and milling the ingot pieces or granules using a jet mill to yield the terbium powder having an average particle size of between 0.5 and 3 μm; an oxygen content of the terbium powder is less than 1500 ppm, and a carbon content of the terbium powder is less than 900 ppm.

3. The method of claim 1, wherein in (3), the terbium powder accounts for 50-80 wt. % of the total weight of the slurry, the antioxidant accounts for 1-10 wt. % of the total weight of the slurry.

4. The method of claim 1, wherein in (3), a thickness of the sintered magnet in at least one direction is less than 15 mm, and a thickness of a terbium powder layer on the surface of the sintered magnet is between 10 and 100 μm.

5. The method of claim 1, wherein in (4), a sintering temperature is between 850 and 970° C., a sintering time is between 5 and 72 hrs, and a sintering pressure is between $10^{-3}$ and $10^{-4}$ Pa; an aging temperature is between 470 and 550° C., and an aging time is between 2 and 5 hrs.

6. The method of claim 2, wherein the terbium powder has an average particle size of between 1 and 2.5 μm; the oxygen content of the terbium powder is less than 1000 ppm, and the carbon content of the terbium powder is less than 700 ppm.

* * * * *